US007413104B2

(12) United States Patent
Schiestl

(10) Patent No.: US 7,413,104 B2
(45) Date of Patent: Aug. 19, 2008

(54) COMBUSTION POWER-OPERATED SETTING TOOL AND A PROPELLANT HOLDER FOR A COMBUSTION POWER-OPERATED SETTING TOOL

(75) Inventor: Ulrich Schiestl, Feldkirch (AT)

(73) Assignee: Hilti Aktiengesellschaft, Schann (LI)

( * ) Notice: Subject to any disclaimer, the term of this patent is extended or adjusted under 35 U.S.C. 154(b) by 115 days.

(21) Appl. No.: 11/122,871

(22) Filed: May 5, 2005

(65) Prior Publication Data

US 2005/0247748 A1 Nov. 10, 2005

(30) Foreign Application Priority Data

May 6, 2004 (DE) ..... 10 2004 022 365

(51) Int. Cl.
*B25C 1/08* (2006.01)
*B25C 1/18* (2006.01)

(52) U.S. Cl. ..... 227/10; 227/9; 227/11; 227/131

(58) Field of Classification Search ..... 227/9, 227/10, 11, 131; 123/46 SC; 431/72, 67, 431/89, 344, 153, 255
See application file for complete search history.

(56) References Cited

U.S. PATENT DOCUMENTS 5,539,188 A 7/1996 Fallah et al.
5,794,831 A 8/1998 Velan et al.
5,873,508 A * 2/1999 MacVicar et al. ..... 227/10
5,911,350 A * 6/1999 Bolger et al. ..... 227/2
6,123,241 A 9/2000 Walter et al.
6,722,550 B1 4/2004 Ricordi et al.

FOREIGN PATENT DOCUMENTS

EP 0586083 3/1994
EP 1156266 11/2001

OTHER PUBLICATIONS

Patent Abstract of Japan JP 07-177044A, Jul. 11, 1995.
Search Report.

* cited by examiner

*Primary Examiner*—Thanh K. Truong
*Assistant Examiner*—Nathaniel Chukwurah
(74) *Attorney, Agent, or Firm*—Abelman, Frayne & Schwab

(57) ABSTRACT

A combustion power-operated setting tool has a propellant-driven setting mechanism, (12) an ignition device (18) for igniting a propellant, a receptacle (15) for receiving a propellant holder (20) and a device (30) for sensing presence of the propellant holder (20) in the receptacle (15) and which blocks ignition of the propellant by the ignition device in absence of the propellant holder in the receptacle (15) and provides for the ignition of the propellant by the ignition device upon sensing the presence of the propellant holder (20) in the receptacle (15).

6 Claims, 3 Drawing Sheets

COMBUSTION POWER-OPERATED SETTING TOOL AND A PROPELLANT HOLDER FOR A COMBUSTION POWER-OPERATED SETTING TOOL

BACKGROUND OF THE INVENTION

1. Field of the Invention

The present invention relates to a combustion power-operated setting tool including a propellant-operated setting mechanism, an ignition device for igniting the propellant, and a receptacle for a propellant holder. The present invention also relates to a propellant holder for a combustion power-operated setting tool.

2. Description of the Prior Art

Setting tools of the type described above can be operated with liquid or gaseous fuels that act as propellants and are generally stored in propellant holders.

German Publication DE-42 43 617 A1 discloses a combustion power-operated setting tool in which during an operational cycle, a gas inlet valve mechanically opens to provide for flow of fuel from a propellant holder into a storage chamber. From the storage chamber, the fuel flows into a combustion chamber before an ignition process is initiated. The propellant holder is formed as a cartridge with a liquefied gas and which is replaceably received in a receptacle of the setting tool.

The drawback of the disclosed setting tool consists in that in case of absence of the propellant holder in the receptacle, the residual fuel in the storage chamber can be still available, and an unintended actuation of a setting process by the tool user can take place, while the user believes that the setting tool is not operation-ready because of the absence of the propellant holder in the tool receptacle.

Accordingly, an object of the present invention is a setting tool of the type described above in which the foregoing drawback of the known setting tool is eliminated.

SUMMARY OF THE INVENTION

This and other objects of the present invention, which will become apparent hereinafter are achieved by providing in a setting tool a device for sensing presence of the propellant holder in the receptacle and which blocks ignition of the propellant by the ignition device in absence of the propellant holder in the receptacle and provides for the ignition of the propellant by the ignition device upon sensing the presence of the propellant holder in the receptacle.

Blocking of the ignition mechanism prevents an unintended ignition of propellant or fuel gas that still remains in the setting tool.

Advantageously, the sensing device includes switching means that opens the ignition current circuit in the absence of the propellant holder in the receptacle and closes the ignition current circuit when the presence of the propellant holder in the receptacle is detected. The switching means insures a very rapid and substantially disturbance-free blocking of the ignition mechanism or of the ignition device.

Advantageously, the sensing device includes a sensor. With a sensor, the presence or absence of a propellant holder in the tool receptacle can be determined in a simple manner, contact-free and reliably. The sensor can be formed, e.g., as a Hall sensor, capacitance sensor, or a light barrier sensor.

It is advantageous when the sensing device includes a touch contact switch which is deflected or pressed by the propellant holder when it is located in the tool receptacle.

With a touch contact switch, a cost-effective construction of the sensing device can be obtained.

Advantageously, the sensor and/or the touch contact switch of the sensing device is arranged in the region of the receptacle, which makes a disturbance-free detection of the presence of a propellant holder in the tool receptacle possible.

It is further advantageous when the propellant holder such as, e.g., a fuel pressure vessel, has sensor means that can be easily recognized by the setting tool sensing device. The sensor means can be formed, e.g., as a permanent magnet, which insures a good detectability of the propellant holder when the sensing device sensor is formed as a Hall sensor.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
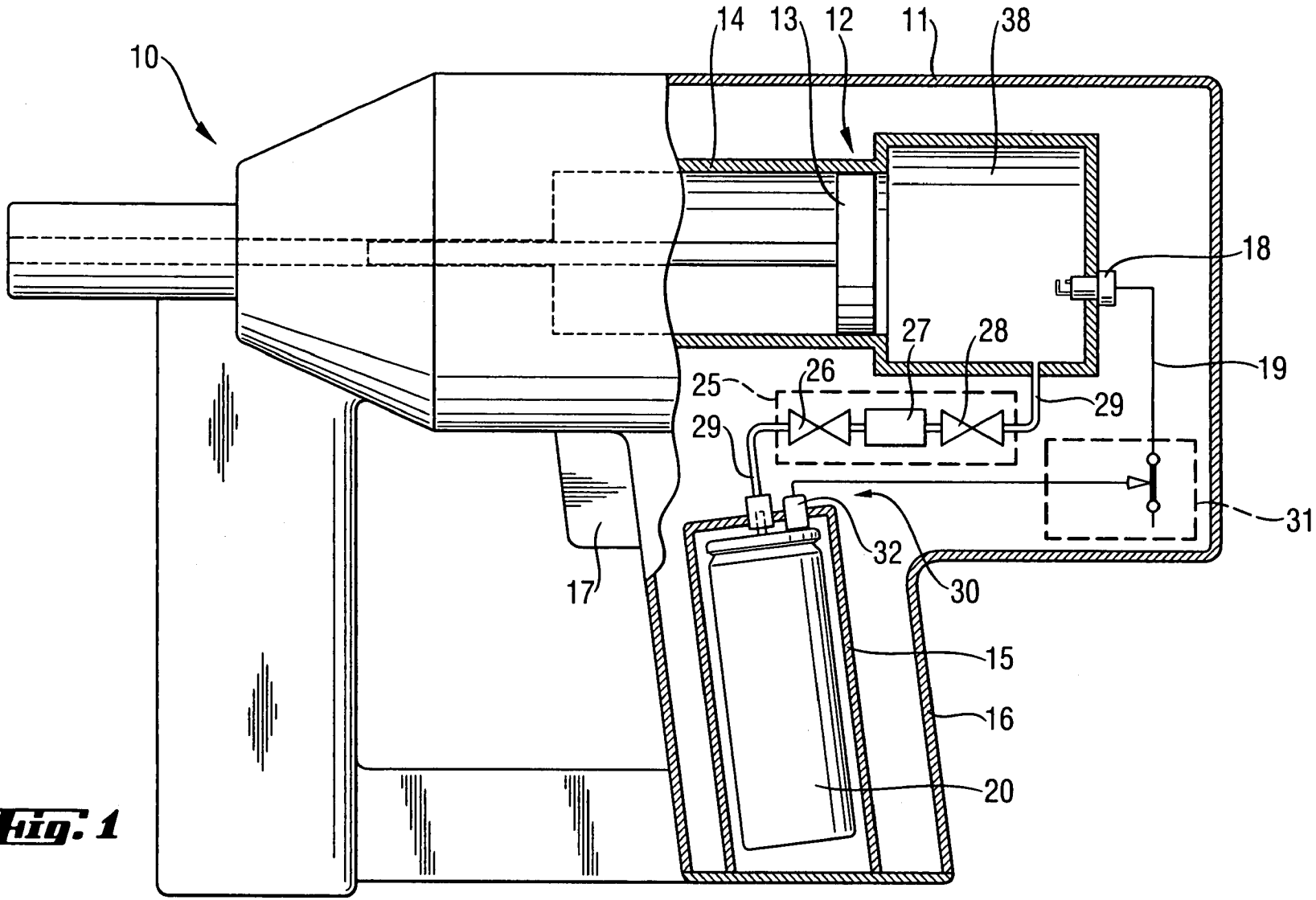
FIG. 1 a side partially cross-sectional view of a setting tool according to the present invention with a propellant holder located in the tool receptacle.
Figure 2:
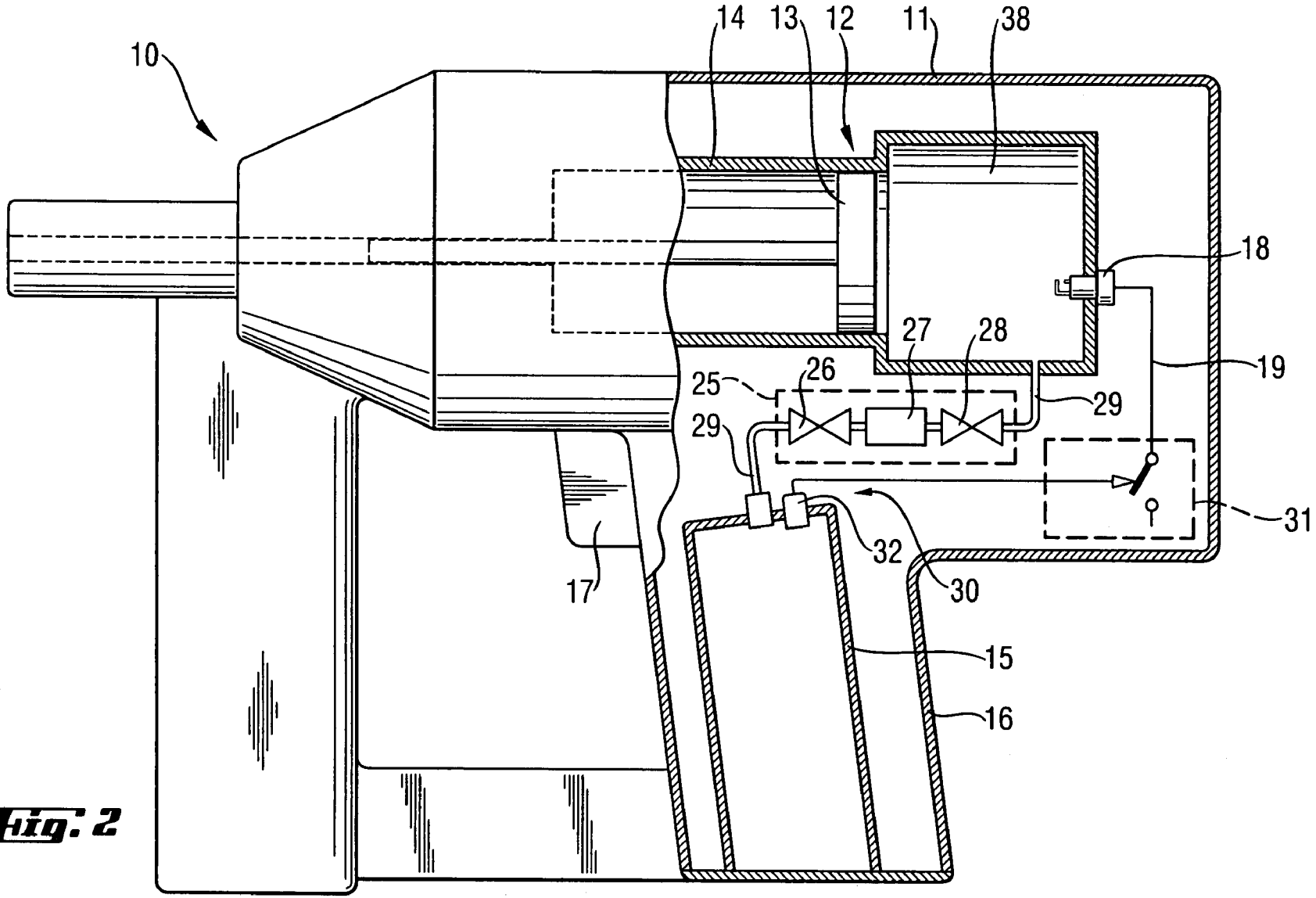
FIG. 2 a side, partially cross-sectional view similar to that of FIG. 1 but without the propellant holder being located in the tool receptacle.
Figure 3:
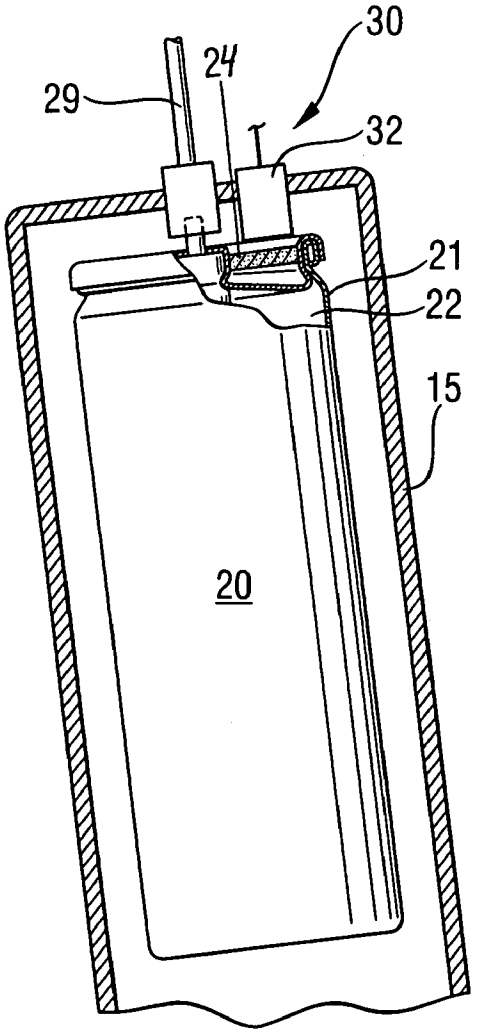
FIG. 3 a side, cross-sectional view showing the receptacle section of the setting tool shown in FIG. 1 with the propellant holder located in the receptacle.

FIGS. 1 through 3 show a setting tool 10 according to the present invention which is driven by a liquid or gaseous fuel that forms a propellant stored in a propellant holder 20. The setting tool 10 has a housing 11 with a handle 16 formed thereon and which is provided with an actuation switch 17 with which a setting process can be initiated. The setting tool further has a setting mechanism 12 that includes a piston guide 14, a drive piston 13 displaceable in the piston guide 14 which is formed as a cylinder, and a combustion chamber 38 adjoining the piston guide 14. The propellant holder 20 is replaceably arranged in a receptacle 15 of the setting tool 10. In the embodiment shown in FIGS. 1-3, the propellant holder 20 is formed as a pressure vessel. A fuel conduit 29 connects the propellant holder 20 with a metering device 25 that includes, e.g.; first and second valves 26, 28 and a chamber 27 arranged between the valves 26, 28. Another section of the fuel conduit connects the metering device 25 with the combustion chamber 38. In this way, the propellant or fuel is fed from the propellant holder 20 through the fuel conduit 29 and the metering device 25 into the combustion chamber 38 of the setting tool 10. In the combustion chamber 38, there is provided an ignition device 18 for igniting an air-propellant mixture located in the combustion chamber 38.

The setting tool 10 further includes a sensing device 30 having a sensor 32, which is formed as a Hall sensor, and switching means 31, e.g., an electronic switch. The sensor 32 is arranged on the receptacle 15, projecting partially into the receptacle interior. The switching means 31 can form part of the sensor 32 or be formed as a separate part, as shown in FIGS. 1 and 2. The switching means 31 forms part of an ignition current circuit 19 and closes or opens the same.

The propellant holder 20, which is formed as pressure vessel, has a housing 21 in an interior 22 of which the propellant in form of gaseous and/or liquid fuel, e.g., a liquefied gas is stored. The propellant holder 20, which is shown in FIGS. 1 and 3, has, at its side adjacent to the fuel conduit 29, sensor means 24 formed as a permanent magnet. The sensor means 24 cooperates with the sensor 32, which is formed as a Hall sensor, of the sensing device 30 of the setting tool 10. By sensing the presence of the sensor means 24, the sensing device 30 ascertains presence of the propellant holder 20 in the receptacle 15 and closes, with the switching means 31, the ignition current circuit 19 as shown in FIG. 1, so that the ignition device 18 can be actuated by the actuation switch 17 when the setting tool 10 is pressed against a constructional component.

FIG. 2 shows the setting tool 10 without a propellant holder located in the receptacle 15 and connected with the fuel conduit 29. However, the propellant can still be located in the conduit 29 and in the chamber 27 of the metering device in particular. However, the sensor 32 would only register the absence of the propellant holder 20 in the receptacle 15, and the switching means 31 would open the ignition current circuit 19. Therefore, an accidental actuation of the setting tool 10 is not possible.

Figure 4:
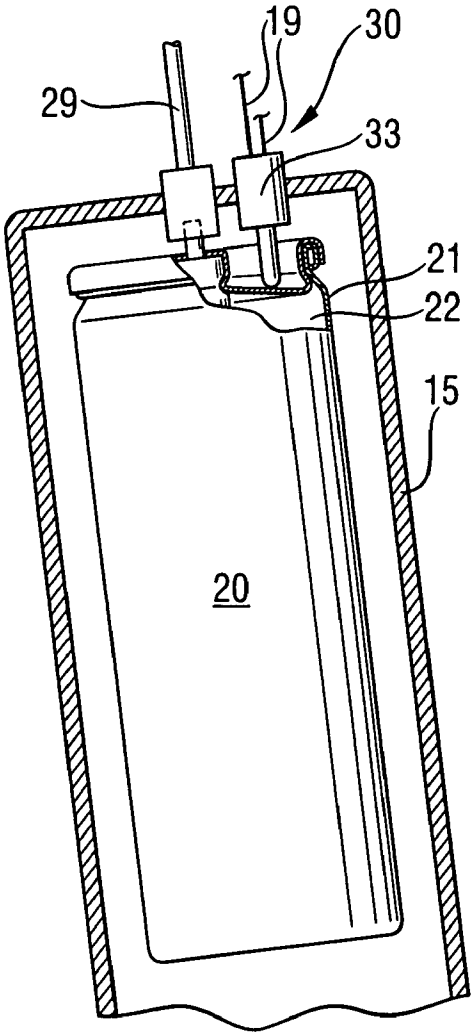
FIG. 4 a cross-sectional view similar to that of FIG. 3 and showing the receptacle section of another embodiment of a setting tool according to the present invention with the propellant holder located in the receptacle.

The setting tool, the receptacle section of which is shown in FIG. 4, differs from the setting tool, which was described above with reference to FIGS. 1-3, in that the sensing device 30 includes, instead of a sensor and switching means, a touch contact switch 33 integrated directly into the ignition current circuit 19. A pure mechanical presence of the propellant holder 20 is detectable by the touch contact switch 33 that opens the ignition current circuit 19 in the absence of the propellant holder 20 in the receptacle 15. Other particularities of this embodiment of the inventive setting tool are the same as of the setting tool 10, which were described with reference to FIGS. 1-3.

Figure 5:
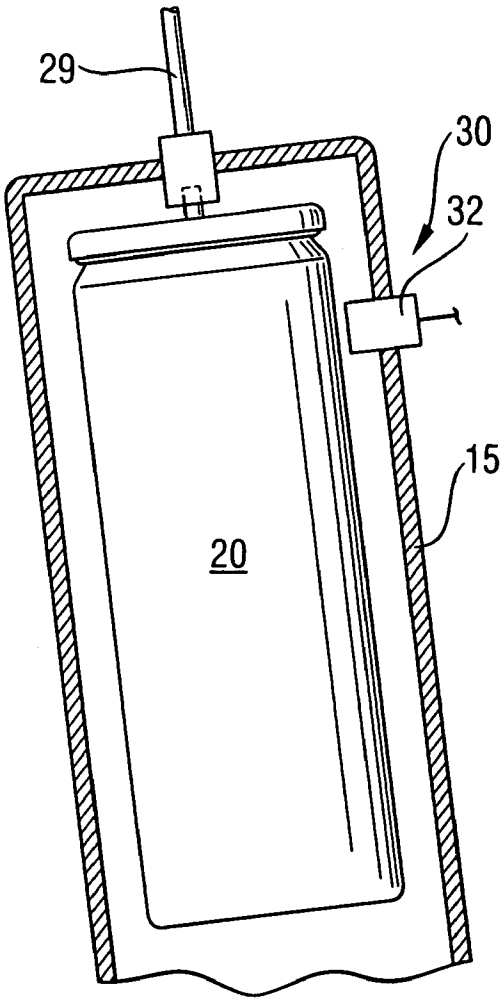
FIG. 5 a cross-sectional view similar to that of FIG. 3 and showing the receptacle section of yet another embodiment of a setting tool according to the present invention with the propellant holder located in the receptacle.

The setting tool, the receptacle section of which is shown in FIG. 5, differs from the setting tool shown in FIGS. 1-3 in that the sensing device 30 has, instead of a Hall sensor, a capacitance sensor 32. The sensor 32 is connected with switching means in the same way as it was described with reference to FIGS. 1-3. In the absence of a propellant holder 20 in the receptacle 15, the capacitance field in front of the capacitance sensor 32 changes. The switching means of the sensing deice 30 opens the ignition current circuit, so that actuation of the setting tool is not possible. All other particularities of the setting tool shown in FIG. 5 are the same as those of the setting tool 10, which were described with reference to FIGS. 1-3. invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion power-operated setting tool, comprising a propellant-driven setting mechanism (12); an ignition device (18) for igniting a propellant; a receptacle (15) for receiving a propellant holder (20); and a device (30) located in a vicinity of the receptacle (15) for sensing presence of the propellant holder (20) in the receptacle (15) and which blocks ignition of the propellant by the ignition device in the absence of the propellant holder in the receptacle (15) and provides for the ignition of the propellant by the ignition device upon sensing the presence of the propellant holder (20) in the receptacle (15).

2. A setting tool according to claim 1, wherein the setting tool comprises an ignition current circuit (19) for feeding current to the ignition device (18), and wherein the sensing device (30) comprises switching means (31) that opens the ignition current circuit (19) in the absence of the propellant holder (20) in the receptacle (15) and closes the ignition current circuit (19) when the presence of the propellant holder (20) in the receptacle (15) is detected.

3. A setting tool according to claim 1, wherein the sensing device (30) comprises a sensor (32) for sensing the presence of the propellant holder (20) in the receptacle (15).

4. A setting tool according to claim 3, wherein the sensor (32) is selected from the group containing Hall sensors, capacitance sensors, and light barrier sensors.

5. A setting tool according to claim 1, wherein the sensing device (30) comprises a touch contact switch (33).

6. A setting tool according to claim 1, wherein the sensing device (30) comprises at least one of a sensor (32) and a touch contact switch (33) arranged in a region of the receptacle (15).

* * * * *